United States Patent [19]

Garcea et al.

[11] 3,937,766

[45] Feb. 10, 1976

[54] MIXTURE CARBURATION DEVICE FOR THE OPERATION IN IDLING CONDITIONS IN PROGRESSION OF AN INTERNAL COMBUSTION ENGINE

[75] Inventors: Giampaolo Garcea; Gennaro Police; Angelo Ciccarone, all of Milan, Italy

[73] Assignee: Alpha Romeo S.p.A., Milan, Italy

[22] Filed: Mar. 4, 1974

[21] Appl. No.: 447,770

[30] Foreign Application Priority Data

Mar. 5, 1973 Italy ..... 21183/73

[52] U.S. Cl. ..... 261/41 D; 261/121 A

[51] Int. Cl.[2] ..... F02M 3/08

[58] Field of Search ..... 261/41 D, 121 A

[56] References Cited

UNITED STATES PATENTS

| | | | |
|---|---|---|---|
| 3,283,751 | 11/1966 | Goossak et al. | 261/41 D |
| 3,382,856 | 5/1968 | McIlroy | 261/41 D |
| 3,533,386 | 10/1970 | Masaki et al. | 261/41 D |
| 3,711,069 | 1/1973 | Hideg et al. | 261/41 D |

FOREIGN PATENTS OR APPLICATIONS

| | | | |
|---|---|---|---|
| 1,217,948 | 1/1971 | United Kingdom | 261/41 D |

*Primary Examiner*—Tim R. Miles

*Attorney, Agent, or Firm*—Waters, Schwartz & Nissen

[57] ABSTRACT

A fuel feeding system for internal combustion engines, of the type comprising a carburettor with a throttle controlling the main flow of fuel-air mixture to the cylinders, the carburettor further comprising a pre-mixing chamber for the air-fuel mixture, which communicates with the engine intake duct by means of ports located both upstream and downstream of the throttle in its closed condition, said pre-mixing chamber feeding also with air-fuel mixture a secondary chamber, communicating both with the atmospheric air and with the intake duct downstream of the said throttle, whereby the fuel-air ratio is kept constant both at idling and at low RPM of the engine.

8 Claims, 8 Drawing Figures

Figure 3:
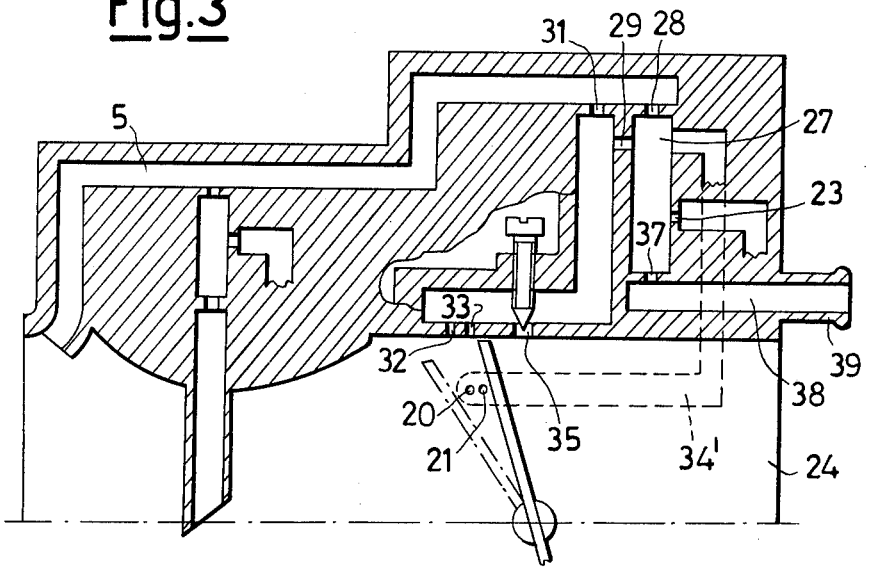

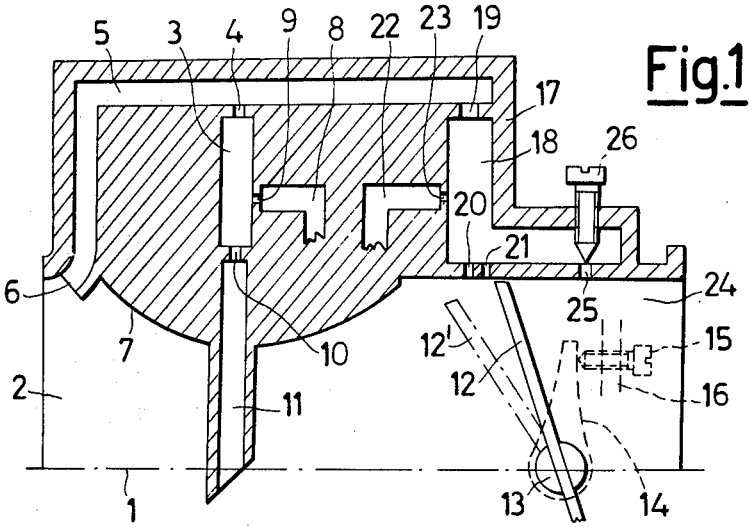
Fig.1
Fig.2
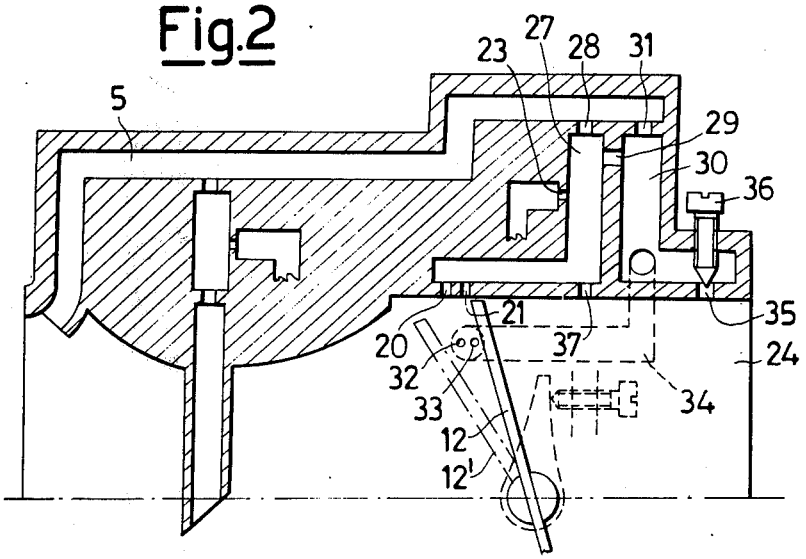

MIXTURE CARBURATION DEVICE FOR THE OPERATION IN IDLING CONDITIONS IN PROGRESSION OF AN INTERNAL COMBUSTION ENGINE

It is known that, with a view to reducing as far as practicable the noxious exhaust emissions of an internal combustion engine, one of the most important routes to follow is that of feeding the engine concerned with a perfectly metered mixture, that is, one in which the ratio of the air weight to the petrol weight is such as to allow an almost complete combustion of the fed-in petrol. Inasmuch as the formation of the mixture and thus the metering of the petrol with respect to air are entrusted in the majority of the cases to the carburettor, improvements have been introduced in the latest years in the carburettor design, but more particularly in the constructional technique and the control of the mass-produced carburettors. The considerable uniformity of the functional features which has thus been achieved for the mass-produced carburettors has improved the situation from the point of view of pollution prevention, but a few considerable difficulties are still left, which the device of the present invention aims at doing away with.

Such difficulties are a result of the following factual situations:

a. The overall magnitude of internal frictions in the usual internal combustion engines is not the same for all the as-produced new engines, even when the machining tolerances are extremely strict and the check-ups very accurate. Said overall magnitude of the internal frictions for a particular engine, moreover, varies during progress of use, that is, during the service life of the engine concerned. These variations of the magnitude of the internal frictions have, on the behaviour of the engine, an influence which, obviously, is much more conspicuous when the engine runs in no-load idling or when it delivers low powers; under these conditions, in fact, the thermal energy of combustion, as a whole, or to a considerable degree, is used just to overcome these frictional forces.

b. The conventional-type carburettors have a so-called principal system for the formation and metering of the mixture at fair and high powers; this principal system generally utilizes the negative pressure of a Venturi for the suction and metering of the petrol; they have, however, also another system, called idling and progression system, which is operative at no-power (that is, with the engine in no-load idling) and at moderate powers (that is when the engine is in progression). The adjustment of this additional system of the carburettor should thus be modified by the special intervention of an engineer, in connection with the magnitude of the internal frictions of the particular engine on which it is mounted and also in connection with the use during the service life of the engine in question.

c. In the intervention as in (b) above, the internal thermal power supplied by the combustion of the mixture, and thus the rate of flow of the mixture supplied to engine, should obviously be proportioned to the power absorbed by the frictional forces.

In the carburettors there are generally provided means for the adjustment of the idling and progression system, but the intervention by the engineer is not usually convenient if it is desired that the rate of flow of the mixture as at (c) above be varied without simultaneously altering the mixture ratio. If, then, the operation is not made by an engineer who is skilled and has adequate checking means available, the intervention can be conducive to an alteration of the admixture ratio and thus to an increase of pollutants in the exhausts, so that the intervention could compromise or even destroy the advantages which should be inherent in the improvements in the design and construction of the carburettors.

The device according to the present invention has been designed from a theoretical point of view by setting up a mathematical model; the theoretical results have been confirmed by field trials. An object of the invention is to solve the problem of providing an idling and progression system for which the admixture ratio is in no wise altered, not only in idling conditions but also in progression (that is, also for scarce powers as delivered by the engine within the entire field of operation of the idling and progression system), due to the effect of said intervention, which is carried out on a single adjustment means available to the engineer: the latter adapts thus to the particular magnitude of the internal frictions of the engine the rate of flow drawn under idling conditions by acting on the single adjustment means, so as to bring to the prescribed value the RPM of the idling engine.

The device is thus so constructed that the intervention does not give rise to an increase in the emissions and that it is not required a particular skill to the engineer and that exhaust gas analyzers are not necessary to check the effect of the manipulation.

In order to make it clear which are the basic ideas of the suggested device, it will be recalled in the following which is generally the functional diagram of the idling and progression system in a normal carburettor in the two extreme conditions of idling engine and engine operating under conditions of maximum progression, and which is the intervention which is possible by an engineer to match the thermal internal power supplied by the combustion of the mixture (and thus the rate of flow of the mixture) with the magnitude of the internal frictions of the engine concerned also in relation with the service life of the engine.

Subsequently, there will be illustrated a few exemplary embodiments of the device according to the present invention.

In the accompanying drawings,

FIG. 1 diagrammatically shows a conventional carburettor viewed in cross-sectional view.

FIGS. 2 to 8 diagrammatically show in cross-sectional view embodiments of carburettors according to the present invention.

In FIG. 1 there is diagrammatically shown a conventional carburettor as viewed in a fragmentary cross-sectional view through the axis 1 of the feeding duct 2. The principal system of the carburettor is formed by the emulsion chamber 3 as fed through the calibrated hole 4 and to the duct 5 by air drawn at 6, that is, upstream of the Venturi 7. In the chamber 3 the petrol coming from the float chamber (not shown in the drawing) arrives through the duct 8 and to the calibrated hole 9. The premixture of air and petrol flows from the chamber 3 through the calibrated hole 10 and the duct 11 in the restricted area of the Venturi, where the maximum negative pressure existing on the intake duct is experienced upstream of the throttle 12 having its pin 13. The throttle 12 is depicted in the drawing in the position of maximum throttling, that is, with the lever 14 (integral with the pin 13 and thus the throttle 12) in contact with the adjusting screw 15 screwed in the frame 16 of the carburettor body 17. With the throttle 12 closed as shown in the drawing, obviously the principal system described above is inoperative since the rate of flow of the air drawn in by the engine at a minimum and thus the negative pressure in the restricted area of the Venturi is virtually nil. With said position of the throttle, instead, there is the operation of the engine at idling for the feed supplied by the idling and progressions system. With said position of the throttle, the emulsion chamber 18 is fed by external air, both through the duct 5 with its mouth 6 and the calibrated hole 19, and also through the progression holes formed through the feed duct in the vicinity of the edge of the throttle 12 and upstream of the same when it is in the closure position. Two progression holes are indicated by way of example at 20 and 21, in the chamber 18 the petrol coming from the float chamber (not shown) comes through the duct 22 and the calibrated hole 23. The premixture of air and petrol arrives from the chamber 18 to the area 24 of the intake duct (which is downstream of the throttle 12 and is thus under a considerable negative pressure) through the port 25 whose cross-sectional area can be adjusted by the conical-tip screw 26. It is known that for several reasons the edges of the throttle in its closed position do not stick to the inner cylindrical surface of the duct so that the engine, when idling, is fed by a rate of flow of air which flows through the throttle (that is, through the gap between the throttle edges and the internal cylindrical surface of the duct) and by a premixture rate of flow issuing from the port 25. Said premixture can be considerably rich so that, by being admixed with the above cited rate of flow of air, the mixture ratio is obtained which is required for a satisfactory engine operation. With a device of this kind, if the mixture feed is not adequate to the frictional energy of the engine, that is if, for example, the RPM of the idling engine is too low, the intervention by the engineer cannot take place by acting on the screw 15 only in the sense of increasing the rate of flow of air through the throttle since, the rate of flow and the title of the premixture being the same, the mixture drawn by the engine becomes leaner, nor the intervention can take place by acting on the screw 26 only in the sense of increasing the premixture rate of flow because, the title and the rate of flow of air through the throttle being the same, the mixture drawn by the engine becomes richer. The engineer should thus act upon both screws but should have available not only a revolution counter but also an exhaust analyzer to maintain the mixture ratio at the value defined as the optimum value from the point of view of the exhaust pollutants. But even when he has made a correct intervention for the idling operation, he has impaired, by acting on the screw 15, the progression operation since, in fact, he has altered the initial position of the throttle edge with respect to the progression holes and has thus altered the title of the mixture drawn by the engine with very small throttle openings. With said throttle openings, in fact, the operation of the idling and progression system is based, as is known, on the fact that the edge of the throttle during the opening motion is displaced with respect to the progression holes. These holes thus pass from the area upstream of the throttle to the area downstream thereof and the overall cross section for induction of external air in the emulsion chamber 18 is decreased while the overall outlet section is increased in the negative pressure area in the intake duct. The result is a considerable increase in the negative pressure in the chamber 18 and thus an increase in the rate of flow of the delivered petrol; the arrangement and the cross-section of the holes are preset so that this increase of the rate of flow of petrol is proportional to the simultaneous increase in the rate of flow of air flowing through the throttle in its new position. In FIG. 1 there has been indicated at 12' the open throttle so that the holes 20 and 21 are downstream of the throttle: under these conditions the emulsion chamber is fed by external air only through the hole 19 while it is in communication with the negative pressure area of the duct through the holes 20, 21 and 25.

Having thus recalled which is the situation as regards the idling and progression system of conventional type as shown in FIG. 1, the basic ideas of the device according to the invention can be made clear with the aid of FIG. 2, which diagrammatically shows, by way of non-limiting indication, one of the practical embodiments of the device concerned.

The principal system of FIG. 2 is wholly similar to that of FIG. 1. The device suggested in fact regards the idling and progression system which comprises in the first place (as can be seen in the drawing) the emulsion chamber 27 which is fed, under the idling conditions (that is with the throttle 12 in closed position) by external air both through the duct 5 and the calibrated hole 28, and the progression holes 20, 21. Petrol arrives to the chamber 27 through the calibrated hole 23. The mixture of air and petrol flows from the chamber 27 to the area 24 of the intake duct downstream of the throttle 12 through the port 37 which, differently from the corresponding port 25 of FIG. 1, has a fixed calibration. The emulsion chamber 27 differs from the corresponding chamber 18 of FIG. 1 also for the presence of the calibrated port 29 for communication with the balancing chamber 30, which is typical of the device according to the invention. The chamber 30 is arranged in parallel relative to the chamber 27 in the sense that it is also fed, under the idling conditions (that is with the throttle 12 in the closed position) by external air both through the duct 5 to the calibrated hole 31 (akin to hole 28), and through the holes 32 and 33 (akin to the progression holes 20 and 21), the chamber 30 differs from the chamber 27 but due to the fact that it does not receive any petrol so that through the port 34 flows into the area 24 of the intake duct air only. The port 34 in the device suggested herein is adjustable for example by the conical tip screw 36.

The function of the compensation chamber 30 and of the hole 29 of communication with the emulsion chamber 27 can be clearly seen, at the outset, in the idling operation (throttle 12 closed) by observing that a manipulation of the screw 36 in the sense of increasing the area of the port 35 brings about an exactly opposite effect on the richness of the mixture in the two theoretical limiting conditions as follows: (a) zero area of the hole 29, and (b) extremely great area of the hole 29 so as to make identical the negative pressures in the chambers 27 and 30.

In fact, in the case (a) the increase of the area 35 gives rise to a greater rate of flow of air drawn by the engine, whereas the negative pressure in the emulsion chamber 27 and thus the rate of flow of petrol delivered by the hole 23 does not change. The result is that there is a leaner mixture drawn by the engine. In the case (b), conversely, the two chambers behave like a single chamber in which the overall area of the air inlet holes remains unaltered whereas the overall area of the outlet holes is increased by increasing the area of the port 35. There is thus a simultaneous and proportional increase of both the rate of flow of air and the rate of flow of petrol through the hole 23. The increased rate of flow of premixture is admixed with the constant rate of flow of air flowing through the throttle and causes the mixture drawn by the engine to become richer. Between these two hypothetical extreme cases (a) and (b) for which the richness of the mixture is altered in an opposite way by the modification of the port 35 there should be a particular case for which the alteration is nil. The theoretical calculation and the experience have shown the existence of a particular value of the area of the hole 29 at which the manipulation on the screw 36 permits to vary the overall rate of flow of mixture as drawn by the engine without altering the mixture ratio. Slight alterations, if desired, can be obtained with slightly different values with respect to the above indicated particular value.

Quite particular a feature of the suggested device is however the fact that the above indicated problem of regulation is solved not only for the idling operation but also for the operation at slight apertures of the throttle, that is, in progression: the reasoning as made above and relative to the two limiting hypothetical cases can be repeated, in fact, also with the throttle arranged, for example, in the position 12' of FIG. 2 and it has been ascertained that with the same detail of the area of hole 29 also with the progression operation, the manipulations on the screw 36 do not originate any alterations in the mixture ratio. This is a consequence of the fact that, due to the presence of the holes 32 and 33, the behaviour of the two chambers 27 and 30 continues to be functionally a parallel one.

Due to such a parallel operation the device has another feature, that is the one of not impairing the possibility of obtaining in progression those considerable increases of the rate of flow of petrol which are gradually required by the opening of the throttle. The negative pressures which can be attained in the emulsion chamber 27 are, in fact, not below those which can be attained in the emulsion chamber 18 of a conventional carburettor.

The idling and progression system as described above permits also to solve another important problem, i.e. the one of avoiding that a portion of the petrol of the mixture is deposited on the internal walls of the intake duct during idling and progression operation. Under these conditions, in fact, the rate of flow of the mixture as drawn by the engine is extremely poor with respect to the cross-section of the intake duct (a cross-section which is designed for the maximum engine powers). The extremely low velocity of the mixture in the duct which is a result, encourages that deposit of petrol and causes considerable irregularities in feed and especially when the engine and the duct walls are not yet in steady thermal conditions. The possibility afforded for the solution of this problem by the device suggested herein, and the design conditions which are adapted to exploit this possibility, for example in the case of a carburettor body feeding a single cylinder, can be illustrated with the aid of FIG. 3.

The functional diagram of FIG. 3 is the same as that of FIG. 2, as can be seen by comparing the several equivalent members as indicated by the same numerals, even though the arrangement of the elements is not the same in the two diagrams. The important difference between the two Figures is that the emulsion chamber 27 does not communicate with the intake duct downstream of the throttle through the hole 37 directly in the area 24, but communicates with a duct 38 having a cross-sectional area which is very restricted with respect to the intake duct. The other end of the duct 38 (possibly extended for example with a plastics tube slipped onto the fitting 39) can be brought to open in the vicinity of the induction valve of the particular cylinder which is fed by the carburettor body; obviously on account of the high velocity of the mixture flowing through the tube 38, the defects mentioned above are done away with. It is interesting to note that with the device suggested herein, not only at idling but also in progression all the petrol is dispensed through the duct 38 since not only the variable port 35, but also the progression holes have only air flowing therethrough. In this particular approach this depends also on the specially provided elongate shape of the chamber 27 and the fact that the hole for the petrol 23 and the mixture outlet hole 37 are at one end of the chamber and at a lower level with respect to the other holes (in the intermediate portion of the chamber the air flow is always directed downwards so that the petrol is complied to emerge through the hole 37).

Figure 4:
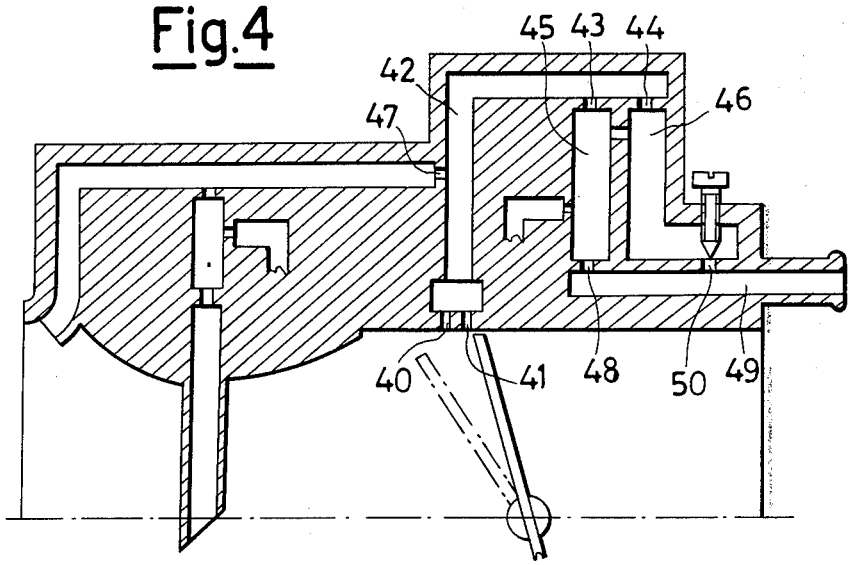

Another possible version of the device suggested herein, still for the case of a carburettor body feeding a single cylinder (as in FIG. 3) is shown in FIG. 4: the version of FIG. 4 is different from the previous one under two respects: (a) the fact that a single set of progression holes (indicated by way of example as the holes 40 and 41) by means of the duct 42 and the two holes 43 and 44, are in communication with the emulsion chamber 45 and the compensation chamber 46; by means of the same duct 42 and the same holes 43 and 44 the two chambers are always in communication through the calibrated hole 47, with the external air upstream of the throttle: the fluid-dynamic behaviour both in idling and progression of this diagram is obviously the same as that of the version shown in FIG. 3, while its construction is simpler); (b) not only the mixture emerging from the emulsion chamber 45 reaches, through the hole 48, the reduced cross-section duct 49, but also the air issuing from the balancing chamber 46 reaches, through the adjustable port 50, said duct 49, the result is that, if the cross-sections are equal, that the petrol transfer velocity towards the intake valve of the particular cylinder fed by the carburettor body is increased.

Figure 5:
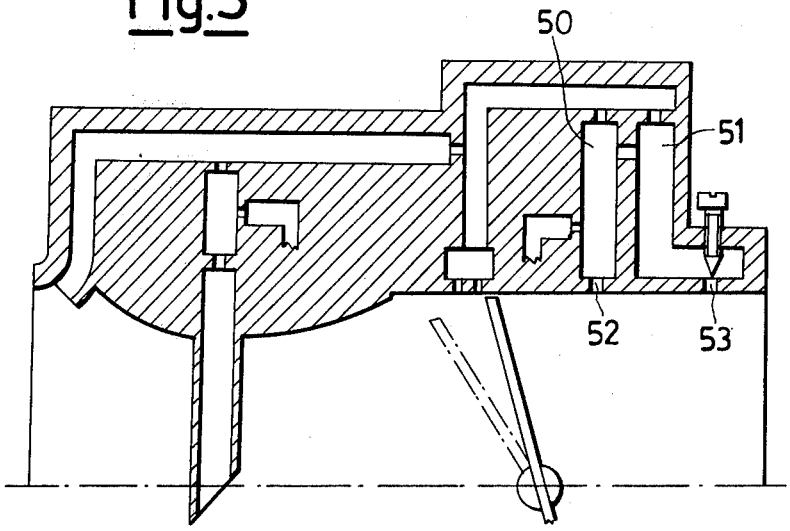

The embodiment of the suggested device as shown in FIG. 5 preferably refers, instead, to the case of a carburettor body which feeds more cylinders simultaneously: with respect to the embodiment of FIG. 4, the embodiment of FIG. 5 differs only in that both the mixture emerging from the emulsion chamber 50 through the hole 52 and the air issuing from the hole 52, and the air issuing from the balancing chamber 51 through the calibrated hole 53, directly reach the intake duct downstream of the throttle rather than the restricted cross-section duct: in the case of a carburettor body feeding more than one cylinder, the negative pressure and the velocity of the mixture flow downstream of the throttle at idling and in progression do not pulsate between a zero value and a maximum value as in the case of a carburettor body per each cylinder; so that the above indicated problem is generally less serious, that is, the deposit of petrol on the duct walls.

It is obvious, however, that in order further to improve the carburation in the several cylinders, and thus minimize the emission of unburned fraction in the exhausts, especially when the engine is cold, the dispensing of premixture to the valves is an asset also in the case of a carburettor body feeding more cylinders. A version of the suggested device which is adapted to the purpose is, by way of suggestion, that shown in FIG. 7 with the aid of FIG. 6 which is reported to the only purpose of making clear the transition to the version of FIG. 7 starting from the versions described hereinabove. The several elements of the scheme in FIG. 6, in fact, are the same as already illustrated in the preceding Figures and the functional diagram is the same: the duct 54 is connected on the one side with the environment upstream of the throttle through the hole 55 and with the intake duct in the vicinity of the progression holes 56 and 57; at the other side it is connected through the hole 58 with the balancing chamber 59, and through the hole 60 with the emulsion chamber 61, the latter being then connected through the hole 62 with the compensation chamber 59, through the hole 63 with the float chamber, through the hole 64 with the restricted cross-sectional area duct 65.

Figure 6:
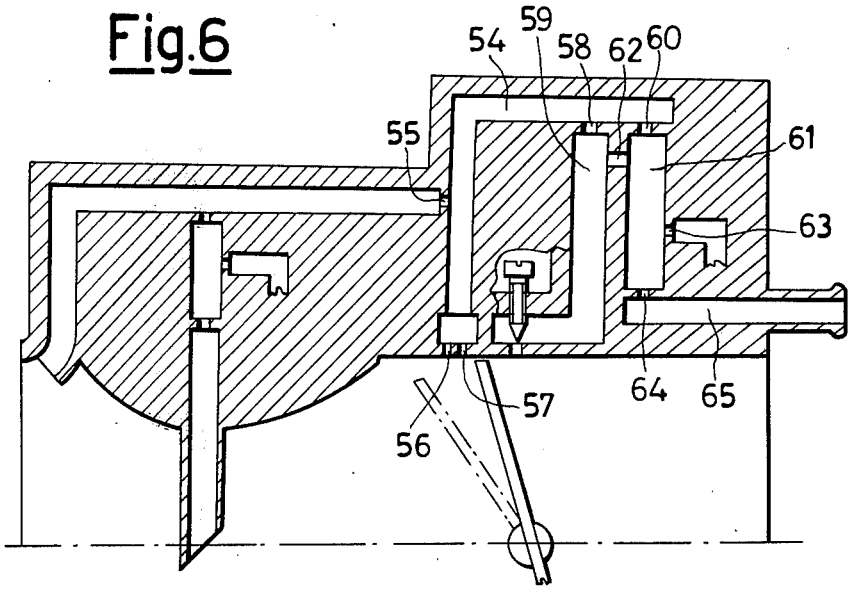
Figure 7:
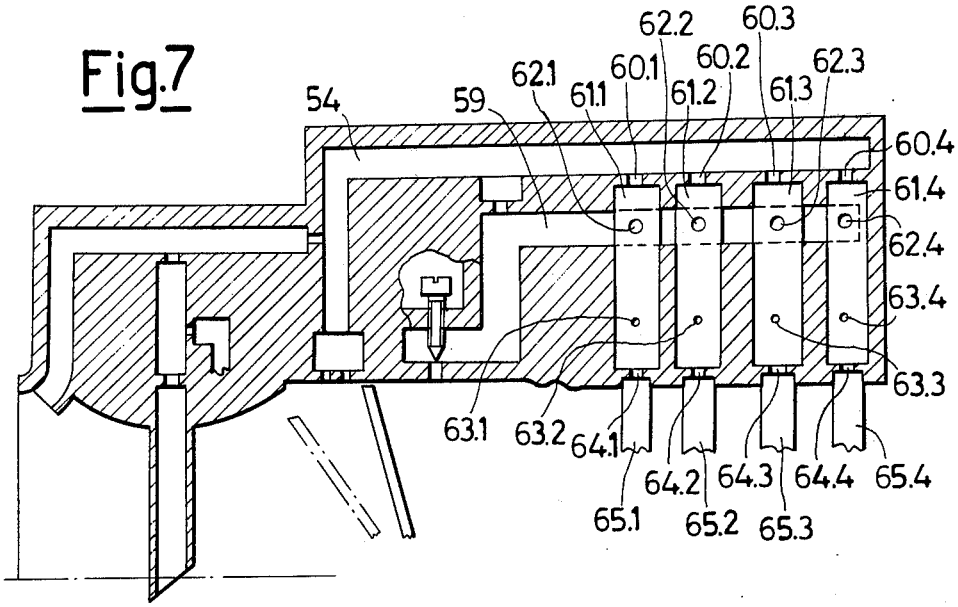

In the diagram of FIG. 7, the other details being the same and especially those referring to the balancing chamber 59, instead of the single chamber 61 of FIG. 6 there is a plurality of emulsion chambers in parallel, for example in the number of four, as shown at 61.1, 61.2, 61.3, 61.4, that is, one for each of the cylinders of a four-cylinder internal combustion engine. These four chambers are connected, each, with the duct 54 through the holes 60.1, 60.2, 60.3, 60.4, each of which has an area which is one fourth of the area of the hole 60 of FIG. 6. They are connected with the balancing chamber 59 through the holes 62.1, 62.2, 62.3 and 62.4 each of which has an area which is one fourth of the area of the hole 62 of FIG. 6. They are connected with the float chamber through the holes 63.1, 63.2, 63.3, 63.4 each of which has an area which is one fourth of the area of the hole 63 of FIG. 6. They are further connected through the holes 64.1, 64.2, 64.3 and 64.4, each of which has an area which is one fourth of the area of the hole 64 of FIG. 6, with the four restricted area ducts 65.1, 65.2, 65.3 and 65.4 which bring the premixture issuing from each of the emulsion chambers in the vicinity of the induction valve of the corresponding engine cylinder.

Figure 8:
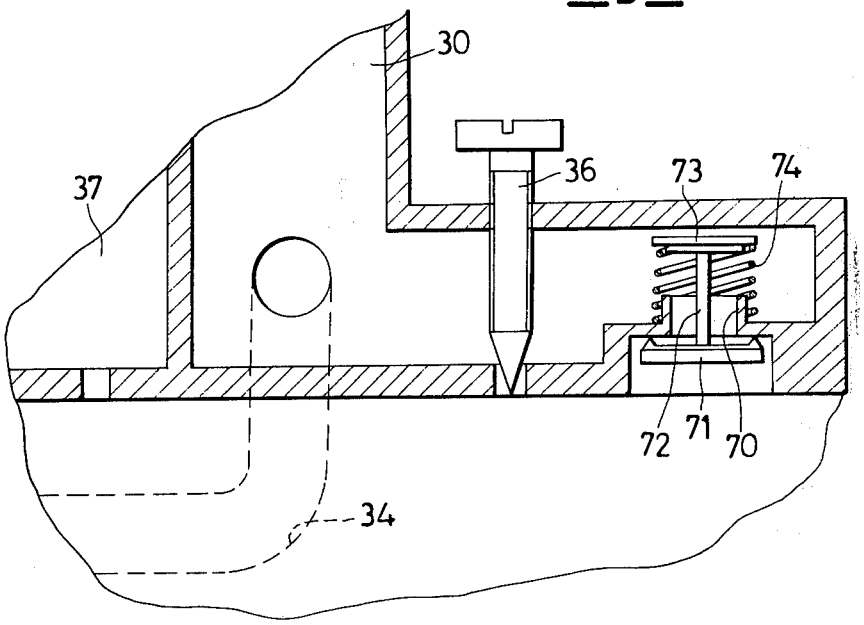

FIG. 8 shows a partial view of a carburettor similar to that shown in FIG. 2 and shows only the portion which has been modified.

More particularly in the curburettor of FIG. 8, between the small chamber 30 and the duct 24 another port 70 opens, as controlled by a shutter 71, to whose stem 72 a cup 73 is fastened.

Between the cup 73 and the wall of the small chamber 30 a spring 74 is compressed.

The spring is calibrated so as to permit the opening of the port 70 when the pressure in the duct 24 falls below a preselected value. The opening of the port 70 in parallel with the adjustable port 35 carries out a supplemental feed when the engine runs at a RPM above idling, with the throttle in the position of minimum opening: this condition takes place for example in deceleration when the engine delivers a braking torque to the vehicle gears when the vehicle runs under inertial forces of its own.

By so doing, an excessive rarefaction of the mixture drawn by the engine is avoided and thus also the inherent difficulties in ignition and emission of considerable fractions of unburned fractions in the exhaust.

The characteristic of constancy of the mixture as obtained with the carburettor according to the invention permit to obtain the important result of increasing the rate of flow of mixture sent to the intake duct, with the supplementary flow through the port 70, without altering the air-petrol ratio which reaches the engine and which can be adjusted to its optimum value.

This alternative, as shown in FIG. 8 as introduced in the carburettor shown in FIG. 2, can similarly be introduced in any carburettor according to the invention, by arranging the port 70 in parallel with the adjustable port which dispenses the idling mixture to the intake duct.

What is claimed is:

1. A carburettor for an internal combustion engine, more particularly for a motor vehicle, said carburettor being of the kind essentially formed by at least a principal system for metering and forming the mixture drawn by the engine during its operation at fair and high powers, by at least an additional system called for idling and progression for metering and forming the mixture drawn by the engine during its operation at no power and at small powers, and by at least one throttle for throttling the mixture fed to the engine, the position of the throttle governing the magnitude of the power delivered by the engine when operating, the improvement wherein said carburettor is characterized in that said idling and progression system is essentially formed by at least one emulsion chamber and a compensation chamber, said at least one emulsion chamber and said compensation chamber communicating each by means of a calibrated hole with a duct which in turn communicates with the intake duct of the engine upstream of the throttle, at least one hole being provided in the feed duct in the vicinity of the throttle edge so as to arrive upstream of the throttle when the latter is closed, that is in the position of maximum throttling, and to come downstream of the throttle when the latter is in a position of slight opening, the feeding duct being put in communication through said at least one hole with a duct, said at least one emulsion chamber and compensation chamber communicating each with said duct and thus communicating each with the intake duct upstream of the throttle when the throttle is closed, downstream of the throttle when the latter is slightly open, said at least one emulsion chamber being in communication with the intake duct in the area downstream of the throttle through a respective calibrated hole and being further in communication with the float chamber through a calibrated hole, whereas said compensation chamber is in communication with the intake duct in the area downstream of the throttle through an adjustable section port, said at least one emulsion chamber being also in communication with said compensation chamber through a respective calibrated hole.

2. A carburettor according to claim 1, further characterized in that said at least one emulsion chamber and said compensation chamber communicating each through a respective calibrated hole with a single duct which is in communication through at least a calibrated hole with the intake duct of the engine upstream of the throttle, said single duct communicating also with the intake duct of the engine through at least a calibrated hole which is provided in the vicinity of the throttle edge so as to become positioned upstream of the throttle when the latter is closed and to become positioned downstream of the throttle when the latter is only slightly open.

3. A carburettor according to claim 1, wherein said at least one emulsion chamber and said compensation chamber communicate, each, through a respective calibrated hole with the intake duct of the engine upstream of the throttle, said at least one emulsion chamber and said compensation chamber further communicating through another respective calibrated hole with a duct which is a single one for all chambers, said single duct communicating with the intake duct of the engine through at least a calibrated hole which is provided in the vicinity of the edge of the throttle so as to become positined upstream of the throttle when the latter is closed and to become positioned downstream of the throttle when the latter is only slightly open.

4. A carburettor according to claim 1, wherein said at least one emulsion chamber and said compensation chamber communicate each through a respective calibrated hole with the intake duct of the engine upstream of the throttle, said at least one emulsion chamber being in communication with the intake duct downstream of the throttle through a respective calibrated hole, being in communication with the float chamber through a respective also calibrated hole, and being in communication with the intake duct through at least a respective first calibrated hole provided in the vicinity of the edge of the throttle, said compensation chamber being in communication with the intake duct downstream of the throttle through an adjustable port, and being also in communication with the intake duct through at least a respective second calibrated hole provided in the vicinity of the edge of the throttle, said first and second calibrated holes provided in the vicinity of the throttle edge being arranged so as to become positioned upstream of the throttle when the latter is closed and to become positioned downstream of the throttle when the latter is only slightly open.

5. A carburettor according to claim 1, wherein said compensation chamber communicates with said intake duct through an adjustable port and a further port, controlled by a shutter member moved to open when the pressure in said duct is below a preselected value.

6. A carburettor according to claim 1 comprising at least a body formed by a principal system, an idling and progression system and a throttle, said carburettor body supplying the mixture to a single cylinder of the engine, in the idling and progression system an emulsion chamber being, as aforesaid, in communication with the intake duct in the area downstream of the throttle through a calibrated hole, said calibrated hole opening into a very restricted area duct with respect to the cross-section of the intake duct, the other end of the restricted section duct opening into the intake duct in the vicinity of the induction valve of the cylinder, the compensation chamber being, as aforesaid, in communication with the intake duct in the area downstream of the throttle through an adjustable section port, said adjustable section port possibly opening also into the aforementioned duct having a very restricted cross section.

7. A carburettor according to claim 1 wherein said at least one emulsion chamber has an elongate shape, in said chamber the calibrated hole of communication with the intake duct in the area downstream of the throttle and the calibrated hole of communication with the float chamber being spaced apart and below with respect to the remaining calibrated holes of the same chamber.

8. A carburettor according to claim 1, wherein a body of said carburettor feeds a plurality of engine cylinders, in which carburettor the idling and progression system is formed by as many emulsion chambers as there are cylinders fed by the carburettor, and by a compensation chamber, each of these emulsion chambers communicating through a respective calibrated hole with an air duct coming from the area upstream of the throttle, further communicating through a respective calibrated hole with said compensation chamber, through a respective calibrated hole with the float chamber, and through a respective outlet calibrated hole with the area of the intake duct downstream of the throttle, said respective outlet hole opening into a respective duct having a cross-section which is very restricted as compared with the section of the intake duct, the other end of said very restricted section duct opening in its turn in the vicinity of the induction valve of the respective cylinder.

* * * * *

UNITED STATES PATENT AND TRADEMARK OFFICE

CERTIFICATE OF CORRECTION

PATENT NO. : 3,937,766

DATED : February 10, 1976

INVENTOR(S) : Giampaolo Garcea et al

It is certified that error appears in the above-identified patent and that said Letters Patent are hereby corrected as shown below:

First page, line 6, change "ALPHA ROMEO S.p.A." to --ALFA ROMEO S.p.A.--

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*